US007337918B2

(12) United States Patent
Fowler et al.

(10) Patent No.: US 7,337,918 B2
(45) Date of Patent: Mar. 4, 2008

(54) TEST STRIP DISPENSER

(75) Inventors: James Fowler, Brewster, MA (US); Robert Daggett, Chelmsford, MA (US)

(73) Assignee: Nova Biomedical Corporation, Waltham, MA (US)

( * ) Notice: Subject to any disclaimer, the term of this patent is extended or adjusted under 35 U.S.C. 154(b) by 20 days.

(21) Appl. No.: 10/904,905

(22) Filed: Dec. 3, 2004

(65) Prior Publication Data

US 2006/0118570 A1 Jun. 8, 2006

(51) Int. Cl.
*B65D 83/00* (2006.01)
*B65H 1/08* (2006.01)
*G07F 11/16* (2006.01)
*B01L 3/00* (2006.01)

(52) U.S. Cl. ..... 221/65; 221/232; 221/268; 221/33; 422/61

(58) Field of Classification Search ..... 221/65, 221/228, 229, 246, 232, 268, 33; 422/61, 422/58, 63
See application file for complete search history.

(56) References Cited

U.S. PATENT DOCUMENTS 781,527 A * 1/1905 Jeffers ..... 206/536
914,040 A * 3/1909 Haines ..... 221/229
2,256,257 A * 9/1941 Dukehart, Jr. ..... 220/8
3,095,085 A * 6/1963 Meijer ..... 206/536
3,109,538 A * 11/1963 Boxer ..... 206/370
3,420,033 A * 1/1969 Modderno ..... 53/470
3,514,008 A * 5/1970 Dorn ..... 220/8
3,563,412 A * 2/1971 James ..... 221/224
3,762,539 A * 10/1973 Kerr ..... 206/537
3,815,734 A * 6/1974 Kruckel ..... 206/443
4,051,977 A * 10/1977 Steinfeld ..... 221/96
4,240,564 A * 12/1980 Pritchard ..... 221/213
4,271,528 A * 6/1981 Brown ..... 455/179.1
4,275,819 A * 6/1981 Perez ..... 221/186
4,353,379 A * 10/1982 Castellanos ..... 131/231
4,784,291 A * 11/1988 Melucci ..... 221/187
4,848,593 A * 7/1989 Jeandaud ..... 221/207
4,887,739 A * 12/1989 Parker ..... 221/232
4,903,860 A * 2/1990 Leopoldi et al. ..... 221/4
5,141,129 A * 8/1992 Jennings ..... 221/154
5,388,693 A * 2/1995 Ceraudo ..... 206/340
5,388,722 A * 2/1995 Kageyama ..... 221/186
5,501,337 A * 3/1996 Sowden ..... 206/528

(Continued)

*Primary Examiner*—Gene O. Crawford
*Assistant Examiner*—Rakesh Kumar
(74) *Attorney, Agent, or Firm*—Robert R. Deleault, Esq.; Mesmer & Deleault, PLLC

(57) ABSTRACT

A strip dispenser has a strip magazine, a magazine spring, a strip vial component, and a cover. The strip magazine has a magazine open end and an outer magazine casing surrounding the strip magazine adjacent the open end for a predefined distance along the strip magazine where the magazine has a magazine volume with an open magazine top. The magazine spring is contained within the strip magazine. The strip vial component has a magazine receiving end, a closed end and a vial recess for slidably receiving the strip magazine between a first position and a second position where the vial recess has a shoulder portion spaced from the closed end and adjacent to and aligned with the open magazine top. The cover encloses the magazine open end and has a slit spaced a predefined distance from an edge of the cover where the slit is in communication with the magazine volume and the open magazine top and in spatial alignment with the shoulder portion.

9 Claims, 7 Drawing Sheets

U.S. PATENT DOCUMENTS 5,579,933 A * 12/1996 Hofmann ..... 215/220
5,649,642 A * 7/1997 Mabry et al. ..... 221/232
5,709,306 A * 1/1998 Hofmann ..... 206/536
5,829,591 A * 11/1998 Lyons ..... 206/373
6,050,449 A * 4/2000 Kanj ..... 221/232
6,230,879 B1 * 5/2001 Lin ..... 206/39.4
6,382,460 B1 * 5/2002 Gonzalez ..... 221/232
6,578,732 B1 * 6/2003 Mabry ..... 221/60
6,953,131 B2 * 10/2005 Devine ..... 221/246
2002/0162849 A1 * 11/2002 Chen ..... 221/65
2003/0106900 A1 * 6/2003 Storz ..... 221/259
2003/0133847 A1 * 7/2003 Hagen et al. ..... 422/104

* cited by examiner

TEST STRIP DISPENSER

BACKGROUND OF THE INVENTION

1. Field of the Invention

The present invention relates generally to containers and vials. Particularly, the present invention relates to test strip vials. More particularly, the present invention relates to test strip dispensers.

2. Description of the Prior Art

Over the years, various kits have been devised that include items known as disposables and/or consumables. The disposables and/or consumables are generally one component of a multi-component kit. These kits are typically used for qualitative testing or quantitative testing or both. For example, kits exist to test for the presence of particular chemical species in the air, smoke stacks, water, and the like. Other kits have been developed for testing the presence of biological species. Still other kits have been developed particularly for use in patient treatment. One example of such a medical test kit is a kit to test the glucose level in blood, particularly for use by diabetics. Some diabetics require testing as often as ten times a day or more.

In all kits that include disposables and/or consumables, the disposable and/or consumable is generally stored in a container. The most commonly used and simple container is a vial. Vials have been used to store various disposable and/or consumables such as adhesives, pH tablets, chlorine tablets, vitamins, test strips, swabs, tongue depressors, etc. More sophisticated kits may include a container combined with a testing instrument. More recently, for example, glucose test meters have incorporated a reservoir to contain a plurality of test strips. Some even use an electro-mechanical device for ejecting a strip while electrically connecting it to the meter for use in making a blood glucose measurement.

There are, however, several disadvantages of the prior art. The use of simply vials creates a risk of spilling the entire contents of the vial when one is extracting a single disposable and/or consumable. In the case where the disposable/consumable is a test strip, the spilled test strips could get contaminated depending on where they were spilled and, if contaminated, would have to be discarded. The more sophisticated, electro-mechanical devices add cost to the kit due to the addition of more complicated and more expensive parts used to eject and electrically connect a test strip for use.

Therefore, what is needed is a strip dispenser that is simple in design and inexpensive to manufacture. What is further needed is a strip dispenser that is a manual device and does not rely on any electro-mechanical components to dispense/eject a test strip or to electrically connect the strip to the meter. What is still further needed is a strip dispenser that reproducibly presents a new test strip to the user without exposing the remaining, stored test strips.

SUMMARY OF THE INVENTION

It is an object of the present invention to provide a strip dispenser that is inexpensive to manufacture. It is another object of the present invention to provide a strip dispenser that is simple to use. It is a further object of the present invention to provide a strip dispenser that dispenses a test strip one at a time without the risk of spilling the contents of the strip dispenser. It is still another object of the present invention to provide a strip dispenser that uses a simple, structural arrangement of components to achieve the consistent dispensing of a test strip one at a time.

The present invention achieves these and other objectives by providing a strip dispenser having a strip magazine, a magazine spring within the strip magazine, a strip vial component with a vial recess and a magazine receiving end for slidably receiving the strip magazine between a first and a second position, and a cover. The strip magazine has a strip container portion, a magazine open end and an outer magazine casing surrounding the strip magazine adjacent the magazine open end. The outer magazine casing surrounds the strip container portion over a predefined distance that is shorter than the length of the strip magazine portion. The strip magazine portion defines a magazine volume with an open magazine top, a magazine bottom, side walls and a distal end wall. The side walls rise to a height that is higher than the distal end wall. The space defined between the top of the side walls and the top of the distal end wall, which is about the thickness of a strip, becomes the strip ejection zone when a strip is ejected from the strip dispenser.

Magazine spring is contained within the bottom of strip container portion to maintain a biasing force against a plurality of strips that are stored within the strip container portion. Magazine spring has a spring body with two spring legs attached at opposite sides and at opposite ends of the spring body. The length of each of the two spring legs is a substantial portion of the length of the spring body and the free ends of the spring legs are nearer the opposite end of the spring body from where the spring legs are connected to the spring body. In the fully extended position, the magazine spring provides the appearance of an "X" such that the legs appear to criss-cross one another in a spaced relationship.

Strip vial component has a first vial portion, a second vial portion, a magazine receiving end, a closed end and the vial recess previously disclosed. The vial recess has a shoulder portion spaced from the closed end and positioned in the vial recess so that it is adjacent to and aligned with the open magazine top. The first vial portion is configured for slidably engaging the inner surface of the outer magazine casing. The first vial portion also incorporates an O-ring groove spaced from the magazine receiving end and in the outer surface of first vial portion. An O-ring placed within the O-ring groove provides controlled resistance to the slidability of the strip vial component in the outer magazine casing.

The second vial portion includes a first stop surface and a second stop surface. First and second stop surfaces permit the strip magazine to move between a first position and a second position and back to the first position to eject a strip from the strip magazine.

The vial recess includes a strip ejection component that has a strip ejection surface. The strip ejection surface engages the end of a strip when ejecting the strip from the strip dispenser. The strip ejection component is configured to slide between the side walls and above the distal end wall of the strip magazine, i.e. within the strip ejection space or zone of the strip container portion. The vial recess also includes a strip positioning surface that extends from the strip ejection surface to the magazine receiving end. The strip positioning surface maintains a strip in proper alignment position during ejection from the strip dispenser. The distance between the strip positioning surface and the top of the strip ejection surface of the strip ejection component is sized to allow the strip ejection surface to push or eject a single strip from the strip magazine. The preferred material for both the strip magazine and the strip vial component is a polymer material such as a plastic.

The cover of the present invention encloses the magazine open end and incorporates a slit spaced a predefined distance from the circumferential edge of the cover. The slit is in communication with the magazine volume and the open magazine top of the strip container portion and is in spatial alignment with the shoulder portion of the vial recess. The circumferential edge, or rim, of the cover secures to, but is removably engaged with, the open magazine end of the outer magazine casing. The cover may be made of any plastic material, but is preferably made of an elastomer such as, for example, a silicone elastomer.

The combination and cooperation of the strip magazine, the magazine spring, the strip vial component and the cover provides a simple, manual way to dispense a single strip from a strip dispenser without exposing all of the strips stored within the strip magazine to the user or potential outside contaminants. The present invention works by simply pulling the strip magazine and the strip vial component away from each other until a first stop position is reached. In the process of reaching the first stop position, several actions concurrently occur internally within the strip dispenser. The strip ejection component moves away from the magazine volume and the top most strip of the stack of strips within the strip magazine is pushed by the biasing force of the magazine spring into an ejection position, i.e. into the strip ejection space or zone. The ejection position places the flat surface of the strip against the strip positioning surface of the vial recess and also places the strip in position for ejection out through the slit in the cover.

As the strip magazine and the strip vial component are moved towards each other to a closed position, the strip magazine engages a second stop surface. During this process, the strip ejection surface of the strip ejection component engages the end of the strip that is in the ejection position and pushes a portion of the strip out of the slit in the cover. The user can then withdraw the entire strip from the strip dispenser. Concurrently with the ejection of the strip, the strip ejection component slides over the surface of the next available strip in the strip stack, thus holding the strip stack in ready position for the next strip ejection procedure.

DETAILED DESCRIPTION OF THE PREFERRED EMBODIMENT

Figure 1:
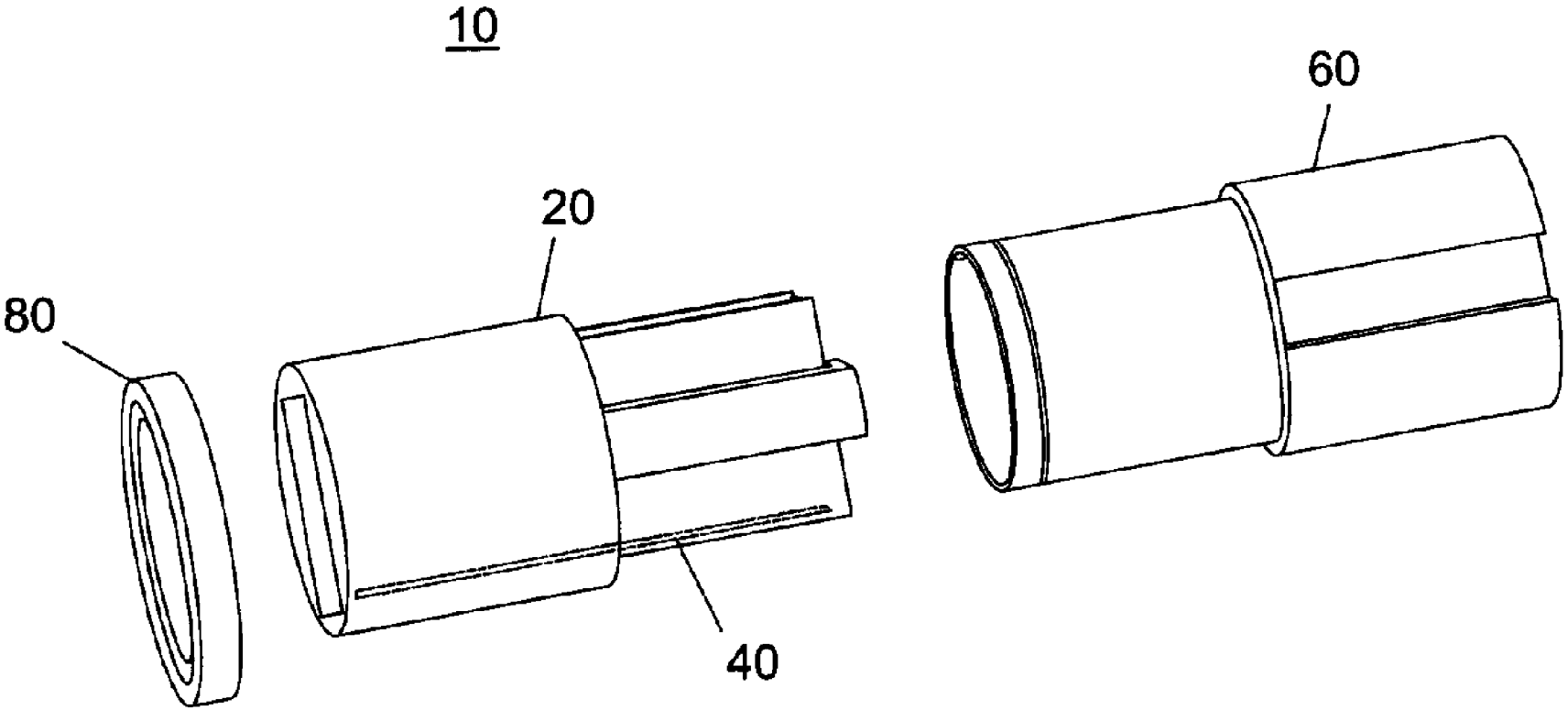
FIG. 1 is an expanded, perspective view of one embodiment of the present invention.

The preferred embodiment of the present invention is illustrated in FIGS. 1-12. FIG. 1 illustrates the test strip dispenser 10 of the present invention. Test strip dispenser 10 includes a strip magazine 20, a magazine spring 40, a strip vial component 60, and a cover 80. Strip magazine 20 and strip vial component 60 are preferably made of a polymer material such as a plastic. Magazine spring 40 may be made of plastic or metal, but is preferably made of metal for longer life.

Figure 2:
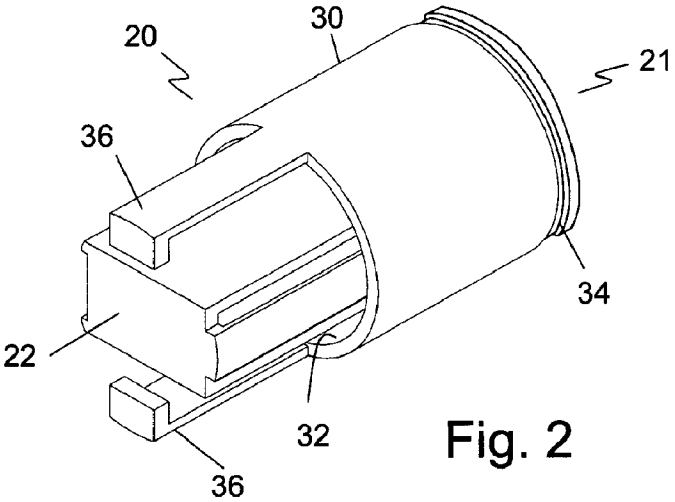
FIG. 2 is a perspective view of one embodiment of the strip magazine of the present invention.

Turning now to FIG. 2, there is illustrated a perspective view of strip magazine 20. Strip magazine 20 includes a strip container portion 22, an outer magazine casing 30 and a magazine open end 21 (not shown). Outer magazine casing 30 surrounds the strip container portion 22 for a predefined distance along the strip container portion 22. An inner surface 32 of outer magazine casing 30 is spaced from outer surface of strip container portion 22.

Outer magazine casing 30 also includes a circumferential groove 34 adjacent magazine open end 21 and a pair of extension portions 36. Circumferential groove 34 is dimensioned to receive cover 80. Extension portions 36, which may also be called casing extension legs, extend beyond the end of strip container portion 22 and are designed to cooperate with strip vial component 60.

Figure 3:
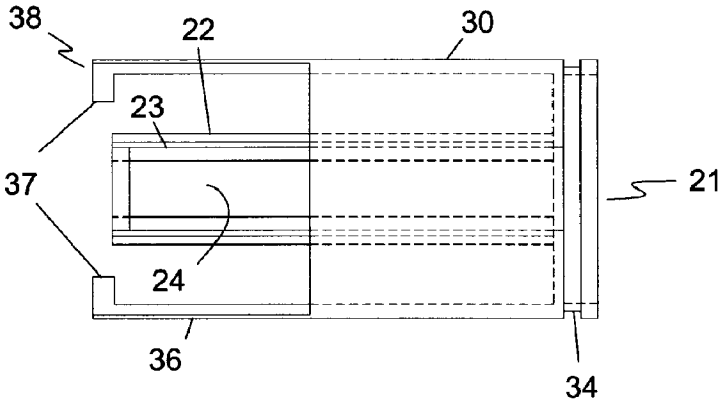
FIG. 3 is a top view of the strip magazine in FIG. 2.

FIG. 3 illustrates a top view of strip magazine 20. Each of extension portions 36 of outer magazine casing 30 includes an extension flange 37 at their distal ends 38. Extension flange 37 is configured to cooperate with a first stop on strip vial component 60 (not shown). Strip container portion 22 defines a magazine volume 24 having an open magazine top 23. Outer magazine casing 30 surrounds strip container portion 22 in a spaced relationship but is integrally connected to strip container portion 22 adjacent magazine open end 21 forming strip magazine 20. It is also important to note that, conceptually, strip magazine 20 may also be seen as a container for holding a plurality of strips that has an outer magazine casing 30 as previously described.

Figure 4:
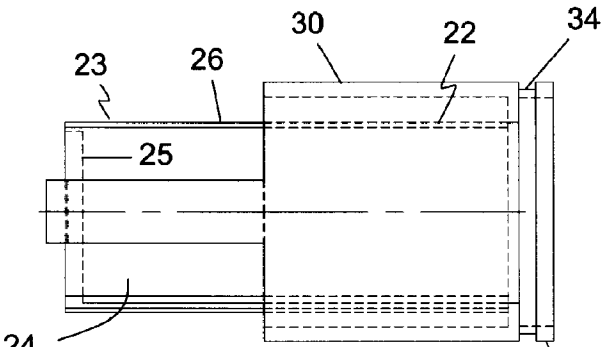
FIG. 4 is a side view of the strip magazine in FIG. 2.

Turning now to FIG. 4, there is illustrated a side view of strip magazine 20. FIG. 4 more clearly illustrates magazine volume 24 and open magazine top 23. Strip container portion 22 has a distal end wall 25 that is shorter than the side walls 26. The distance between the top of distal end wall 25 and the top of side walls 26 is about the thickness of a strip. FIG. 4 also illustrates the surrounding spaced relationship of outer magazine casing 30 to strip container portion 22. As disclosed previously, the preferred material is a polymer material such as a plastic, but more preferably acrylic.

Figure 5:
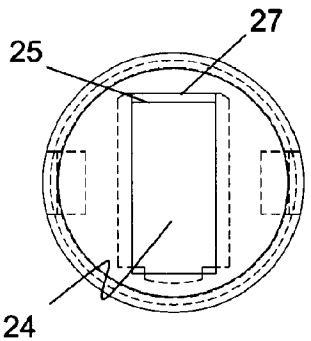
FIG. 5 is an end view of the strip magazine in FIG. 2 showing the magazine open end.

FIG. 5 shows magazine open end 21. As can be seen, distal end wall 25 is shorter than magazine volume aperture 27. This permits the use of an ejection means in the strip dispenser 10 for moving a portion of a strip out the magazine open end 21 for use.

Figure 6:
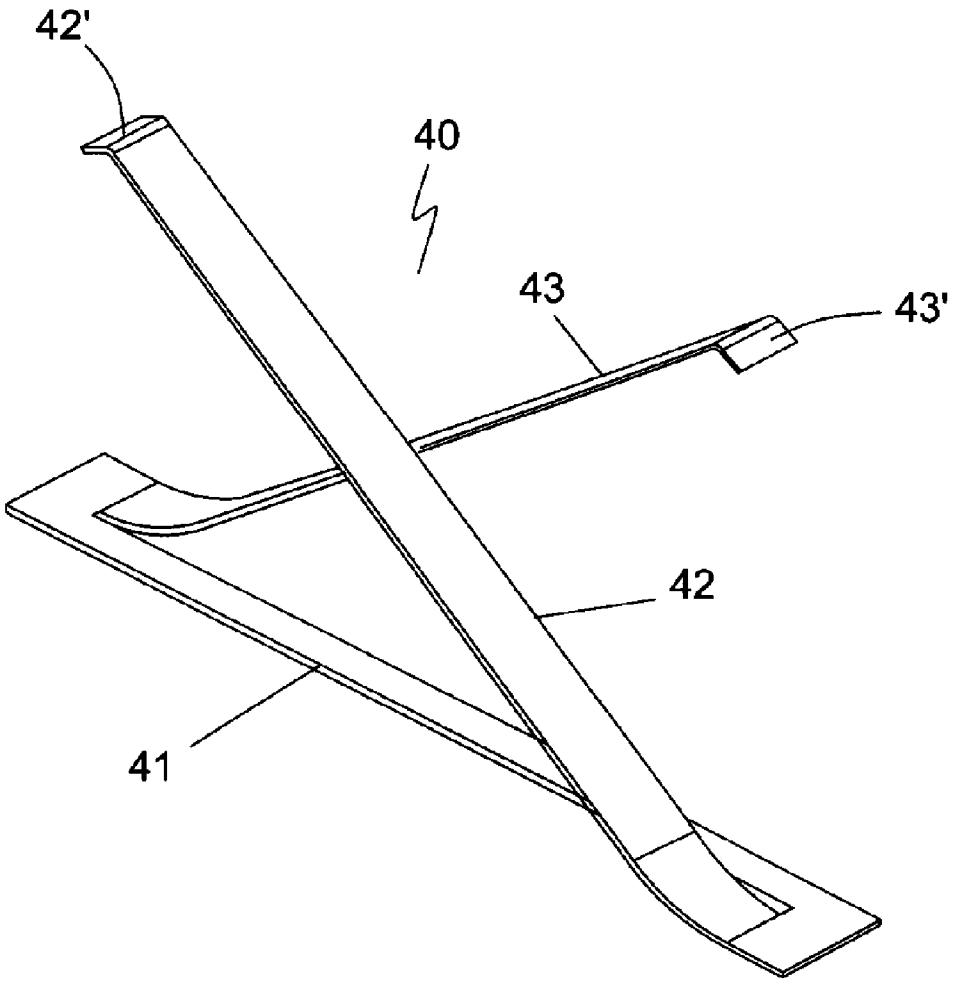
FIG. 6 is a perspective view of the magazine spring used in the embodiment of the present invention shown in FIG. 1.

Turning now to FIG. 6, there is illustrated one embodiment of the magazine spring 40 of the present invention. FIG. 6 is a perspective view of magazine spring 40 having spring body 41, a first spring leg 42 and a second spring leg 43. First spring leg 42 and second spring leg 43 are connected to opposite ends of spring body 41 and on opposite sides such that first spring leg 42 and second spring leg 43 criss-cross one another in a spaced relationship. Each of the spring legs extends in respective planes adjacent to and parallel to the side of spring body 41. Magazine spring 40 is preferably made using about 0.005 in. (0.127 mm) full hard stainless steel that is die cut from flat stock. The ends 42' and 43' of first spring leg 42 and second spring leg 43, respectively, are bent to an inclusive angle of about 109 degrees to the legs. First spring leg 42 and second spring leg 43 provide magazine spring 40 a biased force against the bottom of a stack of strips toward the open magazine top 23. Magazine spring 40 is positioned in the bottom of strip magazine 20 so that the biased spring action of magazine spring 40 causes the top strip to be pushed into an ejection position in strip magazine 20 when strip magazine 20 and strip vial component 60 are slidably moved between a first position and a second position relative to each other.

Figure 7:
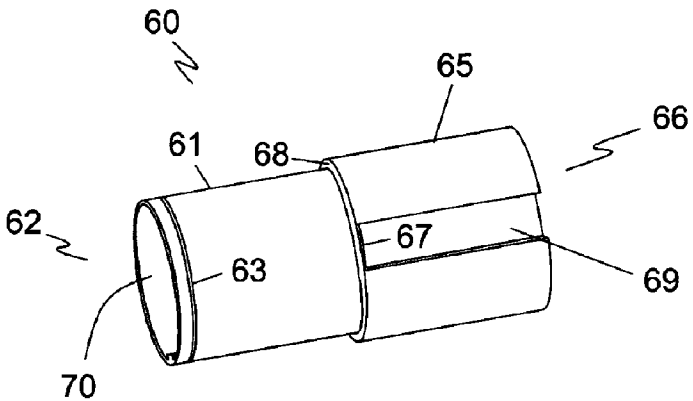
FIG. 7 is a perspective view of the strip vial component of the present invention.

FIG. 7 illustrates a perspective view of strip vial component 60 of the present invention. Strip vial component 60 includes a first vial portion 61, a second vial portion 65, a magazine receiving end 62, a closed vial end 66, and a vial recess 70. First vial portion 61 is configured for slidably engaging inner surface 32 of outer magazine casing 30. First vial portion 61 incorporates an O-ring groove 63 in the outer surface to accommodate an O-ring to provide a controlled resistance to the slidability of strip vial component 60 in outer magazine casing 30.

Second vial portion 65 includes a first stop surface 67 and a second stop surface 68. First stop surface 67 and second stop surface 68 permit strip magazine 20 to move between a first and a second position to eject a strip from strip magazine 20. In the preferred embodiment, second vial portion 65 also includes a casing extension channel 69 for accommodating the outer casing extension portions 36 between the first and second positions. First stop surface 67 engages extension flange 37 of extension portions 36 when strip dispenser 10 is in an extended position for loading a strip into an ejection position. Second stop surface 68 engages the outer rim of outer magazine casing 30 adjacent where the extension portion 36 extends from outer magazine casing 30 when strip dispenser 10 is in a retracted position for storage between uses. It is important to note that the second stop surface 68 may also be a surface near magazine open end 21 between the inner surface 32 of outer casing 30 and strip container portion 22 that is contacted by magazine receiving end 62.

Figure 8:
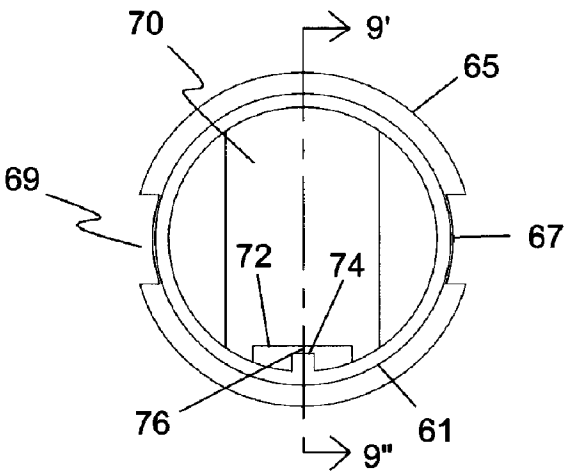
FIG. 8 is an end view of the strip vial component of the present invention showing the magazine receiving end.

FIG. 8 illustrates an end view of strip vial component 60 from magazine receiving end 62. Vial recess 70 includes an ejection means such as strip ejection component 72 with a strip ejection surface or shoulder portion 76. Strip ejection component 72 is configured to slide between side walls 26 and above distal end wall 25 of strip magazine 20. Vial recess 70 also includes a strip positioning surface 74 that extends from strip ejection surface 76 to magazine receiving end 62. Strip positioning surface 74 maintains a strip in proper alignment position for ejection from the strip dispenser 10.

Figure 9:
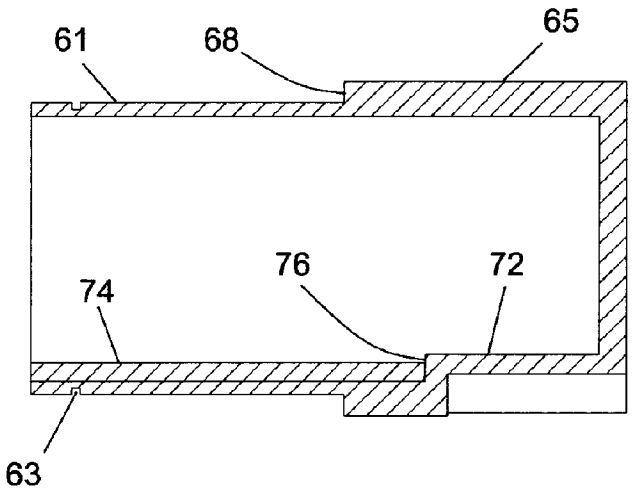
FIG. 9 is a cross-sectional side view of the strip vial component of the present invention.

FIG. 9 is a cross-sectional view of strip vial component 60 taken along line 9'-9" in FIG. 8. Strip ejection surface 76 is more clearly shown in relation to strip ejection component 72 and strip positioning surface 74. The preferred distance between strip positioning surface 74 and the top of strip ejection surface 76 is configured to allow strip ejection surface 76 to push, i.e. eject, a single strip from strip magazine 20. In the present invention, the preferred distance is about 0.018 inches (0.457 mm). The preferred material for strip vial component 60 is a polymer material such as a plastic and, more preferably, acrylic.

Figure 10:
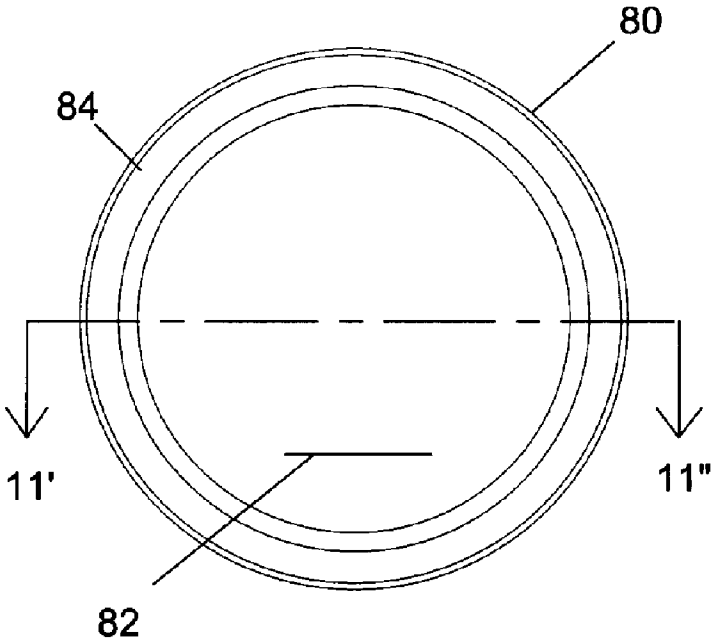
FIG. 10 is a top view of the cover of the present invention.

FIG. 10 illustrates a top view of cover 80 of the present invention. Cover 80 encloses strip magazine 20 at magazine open end 21. Cover 80 includes a slit 82 spaced from the circumferential edge or vial cover rim 84 as the opening through which a strip is ejected. Slit 82 is aligned with the top of magazine volume 24 of strip magazine 20 and strip ejection surface 76. Vial cover rim 84 is configured to securely retain vial cover 80 by engaging circumferential groove 34 of outer magazine casing 30.

Figure 11:
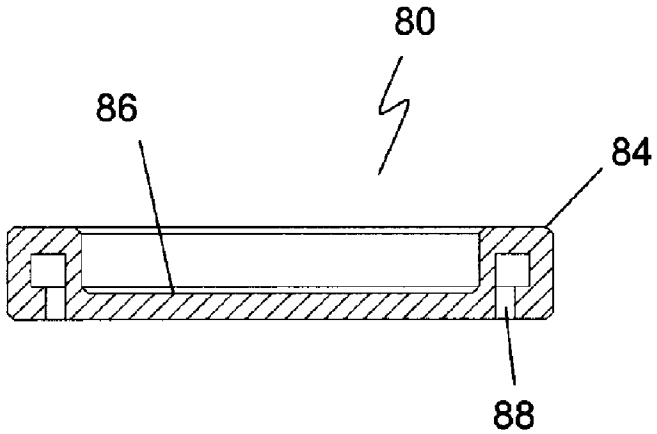
FIG. 11 is a cross-sectional view of the cover of the present invention taken along lines 11'-11" in FIG. 10.

FIG. 11 is a cross-sectional view of cover 80 taken along line 11'-11" in FIG. 10. A central portion 86 of cover 80 is thinner than cover rim 84, and has a preferred thickness of about 0.020 in. (0.508 mm). Vial cover rim 84 has a typical thickness of about 0.140 in. (3.556 mm) and includes a circumferential recess 88 for receiving outer magazine casing end 33. Cover 80 is preferably made of an elastomer, and more preferably a silicone elastomer, and most preferably a medical grade silicone elastomer.

Figure 12A:
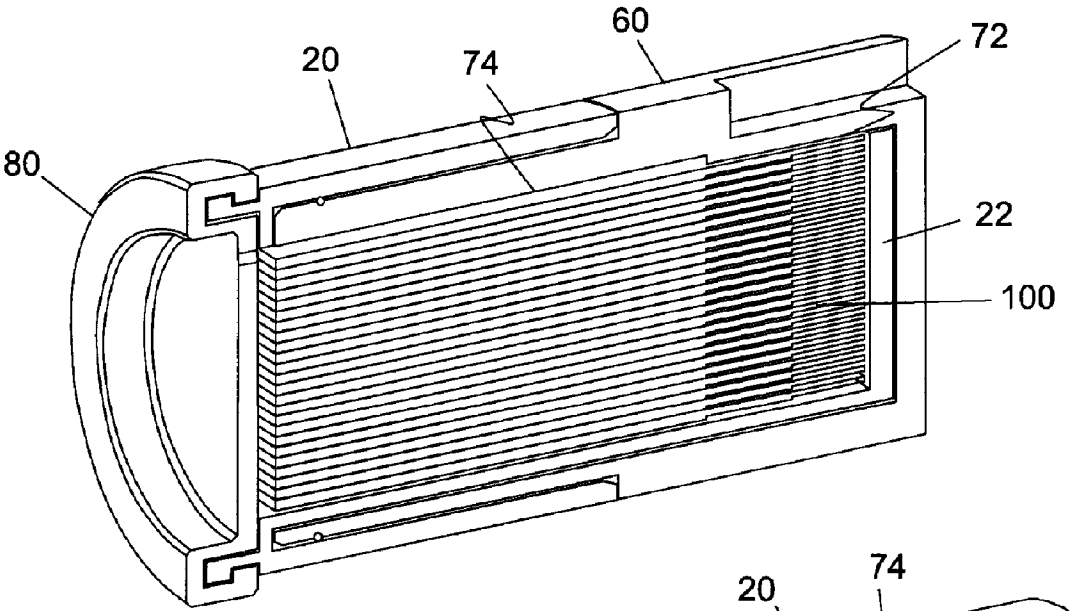
FIG. 12A is a perspective cross-sectional view of the present invention in a closed, first position and containing a plurality of strips in a stack.
Figure 12B:
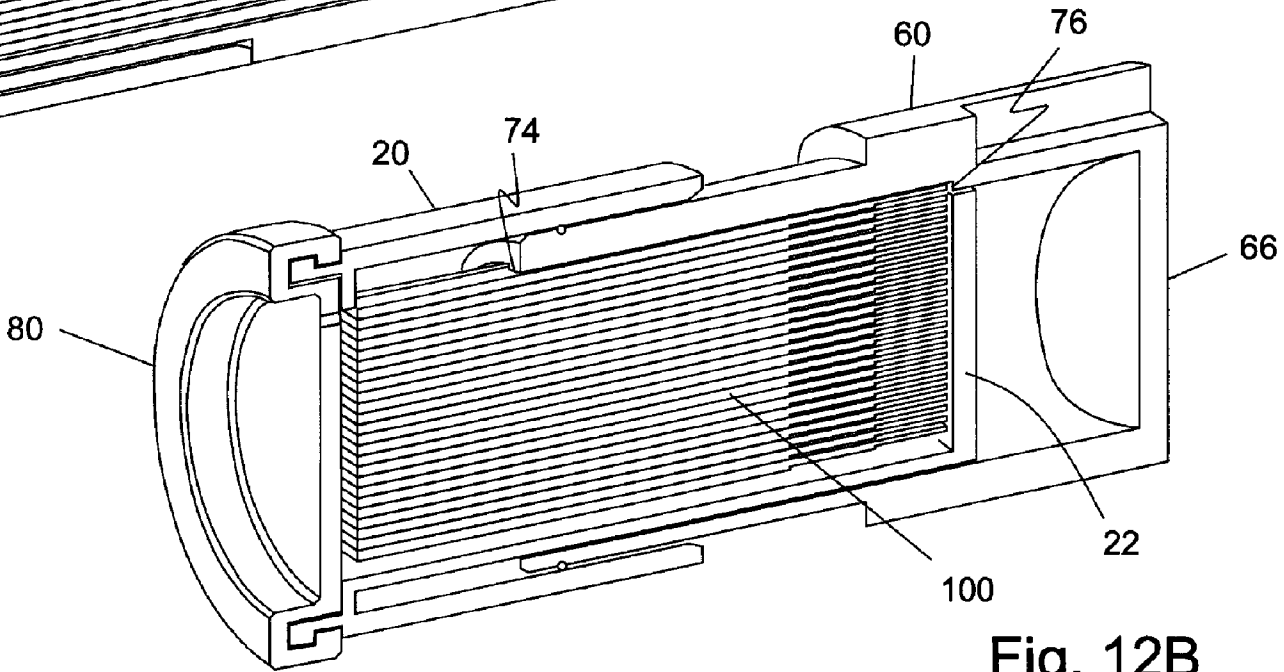
FIG. 12B is a perspective cross-sectional view of the present invention in an extended, second position showing the loading of a top strip in the stack into the ejection position.
Figure 12C:
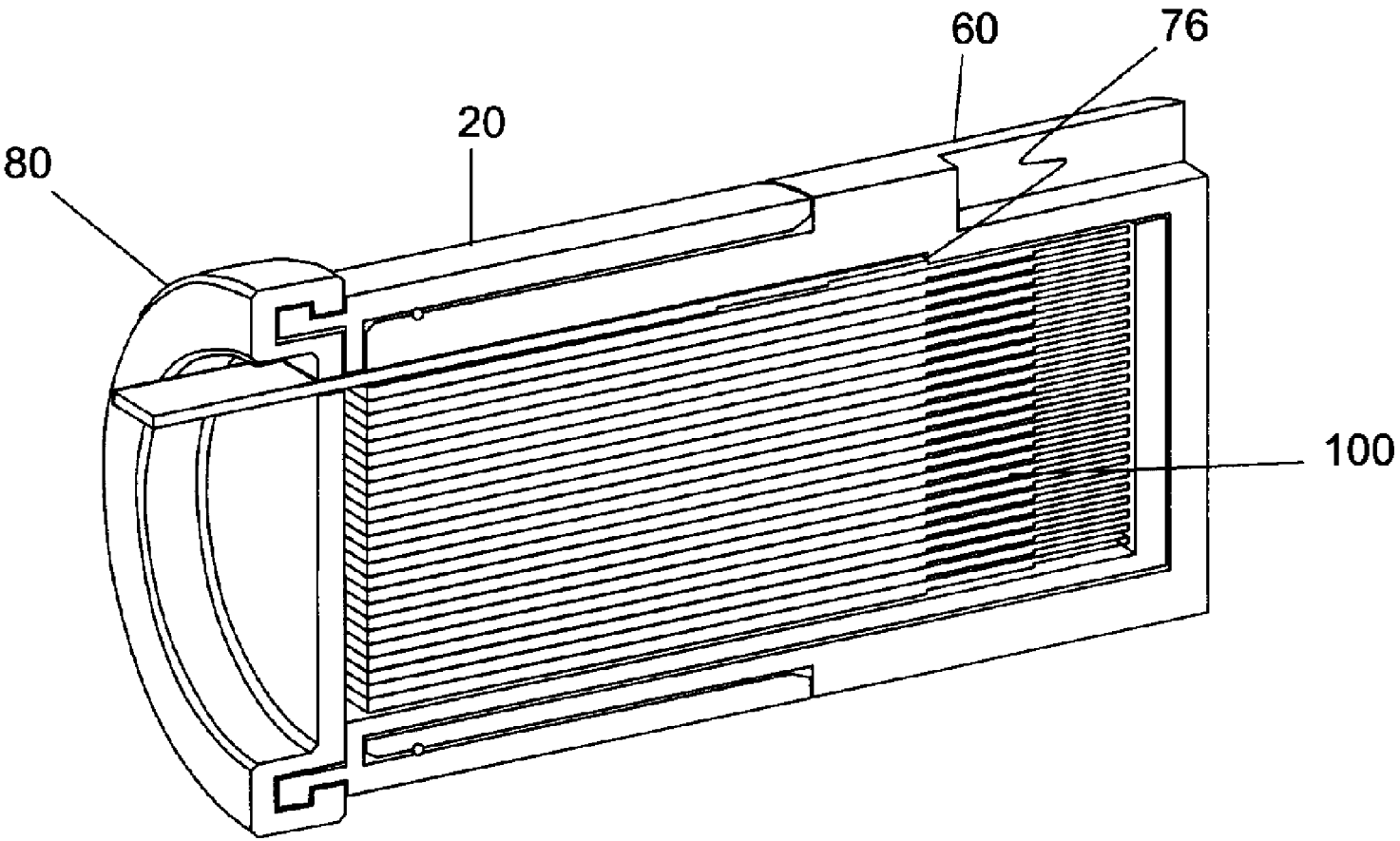
FIG. 12C is a perspective cross-sectional view of the present invention in a strip ejected position showing the partial ejection of the strip.

Turning now to FIGS. 12A, 12B and 12C, there is illustrated a cross-sectional view of strip dispenser 10 in use. FIG. 12A shows the strip dispenser 10 in a first storing position with a plurality of strips 100 stored in strip container portion 22. Strip spring 40 (not shown) is positioned at the bottom of the plurality of strips 100 within strip container portion 22 so that magazine spring 40 pushes the plurality of strips 100 toward open magazine top 23 of strip container portion 22. As can be seen, strip ejection component 72 prevents the top most strip from being positioned within the space or strip ejection zone defined between strip positioning surface 74 and the edge of strip ejection surface 76 of strip ejection component 72.

FIG. 12B shows strip dispenser 10 in an extended, strip loading position in preparation for the ejection of a single strip. As strip magazine 20 and strip vial component 60 are pulled apart, strip container portion 22 moves away from closed vial end 66 but is stopped at a predefined position because first stop surface 67 (not shown) engages extension flange 37 (not shown) of extension legs 36 (not shown). This movement of strip magazine 20 relative to strip vial component 60 allows the top most strip within the stack of strips 100 to be pushed against strip positioning surface 74. It is the biasing force of magazine spring 40 (not shown) against the stack of strips 100 that causes top most strip be placed into this position. In this extended position, the top most strip is now aligned with strip ejection surface 76.

FIG. 12C shows strip dispenser 10 retracted back to its initial position. During the process of pushing strip magazine 20 and strip vial component 60 together, strip ejection surface 76 pushes against the end of the top most strip causing the top most strip to move along strip positioning surface 74 and forcing a portion of top most strip out slit 82 sufficient for a user to grab the strip and remove it from strip dispenser 10 for use.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A strip dispenser comprising:

a strip magazine having a magazine open end, a strip container portion, and an outer magazine casing connected to said strip container portion adjacent said magazine open end, said outer magazine casing extending in a spaced relationship from and surrounding said strip container portion adjacent said magazine open end for a predefined distance along said strip container portion, said strip container portion defining a magazine volume having an open magazine top;

a magazine spring within said strip container portion;

a strip vial component having a magazine receiving end, a closed end and a vial recess for slidably receiving said strip magazine between a first position and a second position wherein said vial recess has a shoulder portion spaced from said closed end and adjacent to and aligned with said open magazine top; and a cover enclosing said magazine open end and having a slit spaced a predefined distance from an edge of said cover wherein said slit is in communication with said magazine volume and said open magazine top and in spacial alignment with said shoulder portion of said vial recess.

2. The dispenser of claim 1 wherein said strip vial component has a first vial portion in slidable engagement with an inside surface of said outer magazine casing of said strip magazine.

3. The dispenser of claim 1 wherein said outer magazine casing has at least an extension portion spaced from said strip container portion and extending along said strip magazine.

4. The dispenser of claim 3 wherein said at least an extension portion is an extension leg.

5. The dispenser of claim 2 further comprising an O-ring between said inside surface of said outer magazine casing and said first vial portion.

6. The dispenser of claim 1 wherein said magazine spring has a spring body and a pair of spring legs biased to force a strip toward said open magazine top.

7. The dispenser of claim 1 wherein said shoulder portion has a thickness of about the thickness of a single strip.

8. The dispenser of claim 1 wherein said strip vial component has a first stop and a second stop configured to operatively engage said strip magazine at said first position and said second position.

9. The dispenser of claim 8 wherein said first stop and said second stop are an integral part of a second portion of said strip vial component.

* * * * *